United States Patent [19]

Bitsch et al.

[11] 4,015,095

[45] Mar. 29, 1977

[54] CONTACT ARRANGEMENT FOR AN ELECTRIC COMPRESSED-GAS CIRCUIT BREAKER

[75] Inventors: Rainer Bitsch; Heiner Marin; Helmut Beier, all of Berlin, Germany

[73] Assignee: Siemens Aktiengesellschaft, Munich, Germany

[22] Filed: Sept. 4, 1975

[21] Appl. No.: 610,230

[30] Foreign Application Priority Data

Sept. 17, 1974 Germany ..... 2444943

[52] U.S. Cl. ..... 200/148 A; 200/147 R

[51] Int. Cl.[2] ..... H01H 33/42

[58] Field of Search ..... 200/148 A, 150 G, 148 R, 200/147 R

[56] References Cited

UNITED STATES PATENTS

| | | | |
|---|---|---|---|
| 3,238,340 | 3/1966 | Lerch | 200/148 A |
| 3,418,440 | 12/1968 | Beatty et al. | 200/147 R |
| 3,745,281 | 7/1973 | Yoshioka | 200/148 R |
| 3,789,175 | 1/1974 | Beier et al. | 200/148 R |

*Primary Examiner*—Robert S. Macon
*Attorney, Agent, or Firm*—Kenyon & Kenyon Reilly Carr & Chapin

[57] ABSTRACT

The invention is directed to a contact arrangement in a compressed-gas circuit breaker such as a blast-piston breaker. The contact arrangement includes two base contacts and a bridging contact member. One of the base contacts is movable as a function of the current to be interrupted and the motion is controlled by two electrodynamic coil systems. One coil system causes a shortening of the gap and the other coil system causes a reverse motion shortly before the zero crossing to establish the quenching distance.

9 Claims, 7 Drawing Figures

CONTACT ARRANGEMENT FOR AN ELECTRIC COMPRESSED-GAS CIRCUIT BREAKER

BACKGROUND OF THE INVENTION

The invention concerns an electric compressed-gas power circuit breaker with a switching gap formed by two base contacts and a movable bridging contact which in the breaker opening operation slides off of the one base contact, the run-off contact, and moves in the direction toward the other base contact. Such a compressed-gas power circuit breaker is known, for instance, in U.S. Pat. No. 3,789,175 in the form of a blast-piston circuit breaker.

It is an object of the invention to reduce the switching energy in a compressed-gas power circuit breaker of the abovementioned type.

To solve this problem, it is known to control the motion of the bridging contact member by an electrodynamic coil system through whose primary coil the current to be interrupted flows. In this connection, reference may be had to Deutsche Offenlegungsschrift No. 2,304,904.

In co-pending U.S. patent application Ser. No. 539,951, filed Jan. 10, 1975, a contact arrangement for an electric pressure-gas circuit breaker is disclosed wherein a follower contact is associated with the run-off contact. The follower contact is insulated with respect to the run-off contact and is movable in the direction toward the other base contact which is stationary against the force of a spring. Also, the follower contact is connected with the current supply to the runoff contact though two coaxial coils, of which the one is stationary and the other is mechanically connected with the follower contact in such a manner that the bridging contact member runs up onto the follower contact when it separates from the run-off contact and the current to be interrupted is commutated onto the circuit branch containing the coils whereby a force acting on the follower contact in the direction toward the other stationary contact is produced between the coils.

SUMMARY OF THE INVENTION

The invention provides a different solution of the stated object. In a compressed-gas power circuit breaker of the type mentioned at the outset, it is a feature of the invention that the run-off contact is movable in the direction toward the other base contact against the force of a spring and is mechanically connected with the secondary coils of two electrodynamically-acting coil systems whose primary coils are stationary and are arranged on mutually opposite sides of the associated secondary coils and carry, during the breaker opening operation, the current to be interrupted. In the first coil system, the secondary coil is disposed in front of the primary coil as referred to the direction of the spring force. The primary and the secondary coils of the first coil system are closely coupled in the stationary condition and the secondary current lags the primary current by about 120° to 150° el.; whereas, in the second coil system, whose secondary coil is disposed behind the primary coil, the primary and the secondary coils are coupled loosely in the stationary condition and the secondary current lags the primary current by about 180° el.

With the invention, electrodynamic control of the runoff contact is achieved in the sense that the breaker switches quasi-synchronously with sufficiently large currents. In the breaker opening operation, the current to be interrupted flowing in the primary coil of the first coil system first generates a large repelling force, by which the run-off contact is accelerated in the direction toward the other base contact, that is, in the sense of shortening the gap. Shortly before the zero crossing, this force changes, because of the indicated phase angle of the first coil system, to an attraction force in the sense of lengthening the gap. A back acceleration of the run-off contact in this direction, however, is caused to the greater part by the second coil system which always generates a repelling force which increases as the run-off contact approaches the other base contact because the coupling of the second coil system becomes greater. The consequence of this force is that at the zero crossing, the necessary extinguishing distance between the base contacts exists.

A contact, which is actuated at the beginning of the breaker opening motion, may be provided for commutating the current to be interrupted to the primary coils. However, the primary coils may also be electrically connected directly in the closed condition with the run-off contact, the current being supplied to the bridging contact member through a fixed contact which is insulated from the run-off contact. Here, the commutation of the current to the primary coils sets in when the bridging contact member passes from the fixed contact to the run-off contact.

In a preferred embodiment of the invention, the current to be interrupted flows at first, at the beginning of the breaker opening operation, only through the primary coil of the first coil system, while the other primary coil is connected only later by an auxiliary contact taken along by the run-off contact. This facilitates the commutation of the current to be interrupted to the primary coils; it is a further advantage of this switching sequence that the repelling action of the second coil system takes place only shortly before the end of the breaker opening operation.

The auxiliary contact can also be configured so that it disconnects the primary coil of the first coil system in the course of its movement. In this way, only the back acceleration by the second coil system is still effective in the second part of the breaker opening operation.

The invention is of particular importance for blast-piston circuit breakers also known as single-pressure breakers; but it can also be applied to dual-pressure breakers, in which the quenching gas is stored by means of a compressor in a high-pressure tank and flows off into a low-pressure tank in the switching-off process.

Although the invention is illustrated and described herein as a contact arrangement for an electric compressed-gas circuit breaker, it is nevertheless not intended to be limited to the details shown, since various modifications may be made therein within the scope and the range of the claims. The invention, however, together with additional objects and advantages will be best understood from the following description and in connection with the accompanying drawings.

whereas, the portion of FIG. 1 below the center line shows the contact arrangement in the open position.

Figure 2:
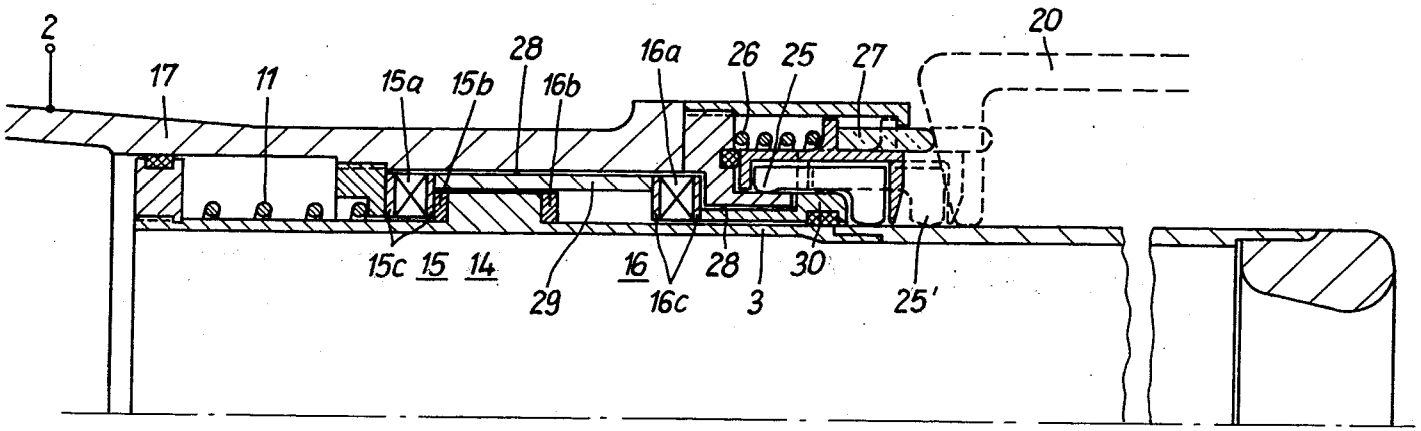

FIG. 2 is a schematic diagram showing the control device of the contact arrangement according to the invention for controlling the movement of the run-off contact.

Figure 3:
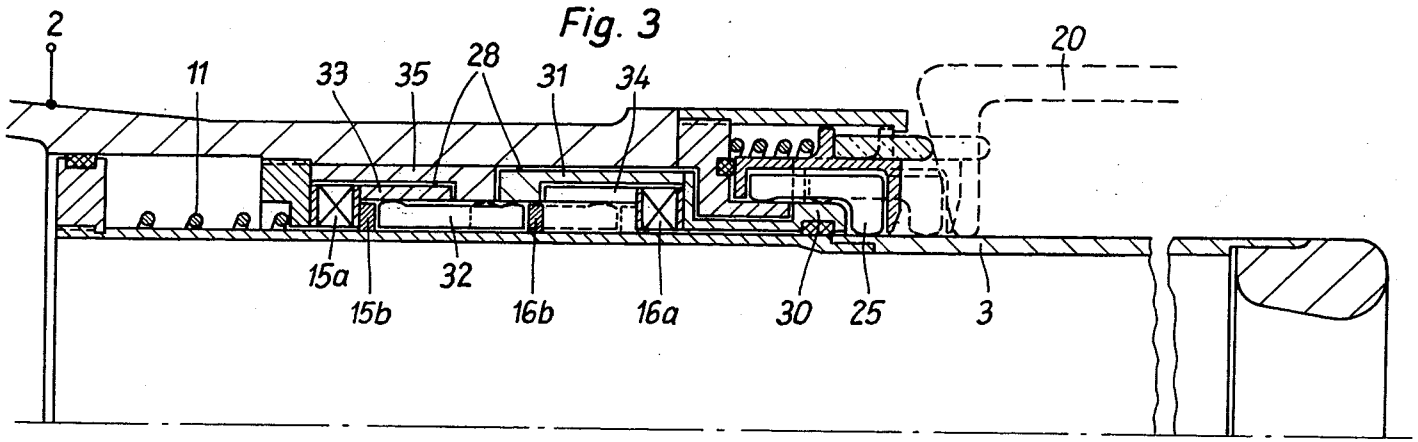

FIG. 3 illustrates a commutating arrangement for sequentially energizing the primary coils of the control device shown in FIG. 2.

Figures 4, 4A, 5, 6:
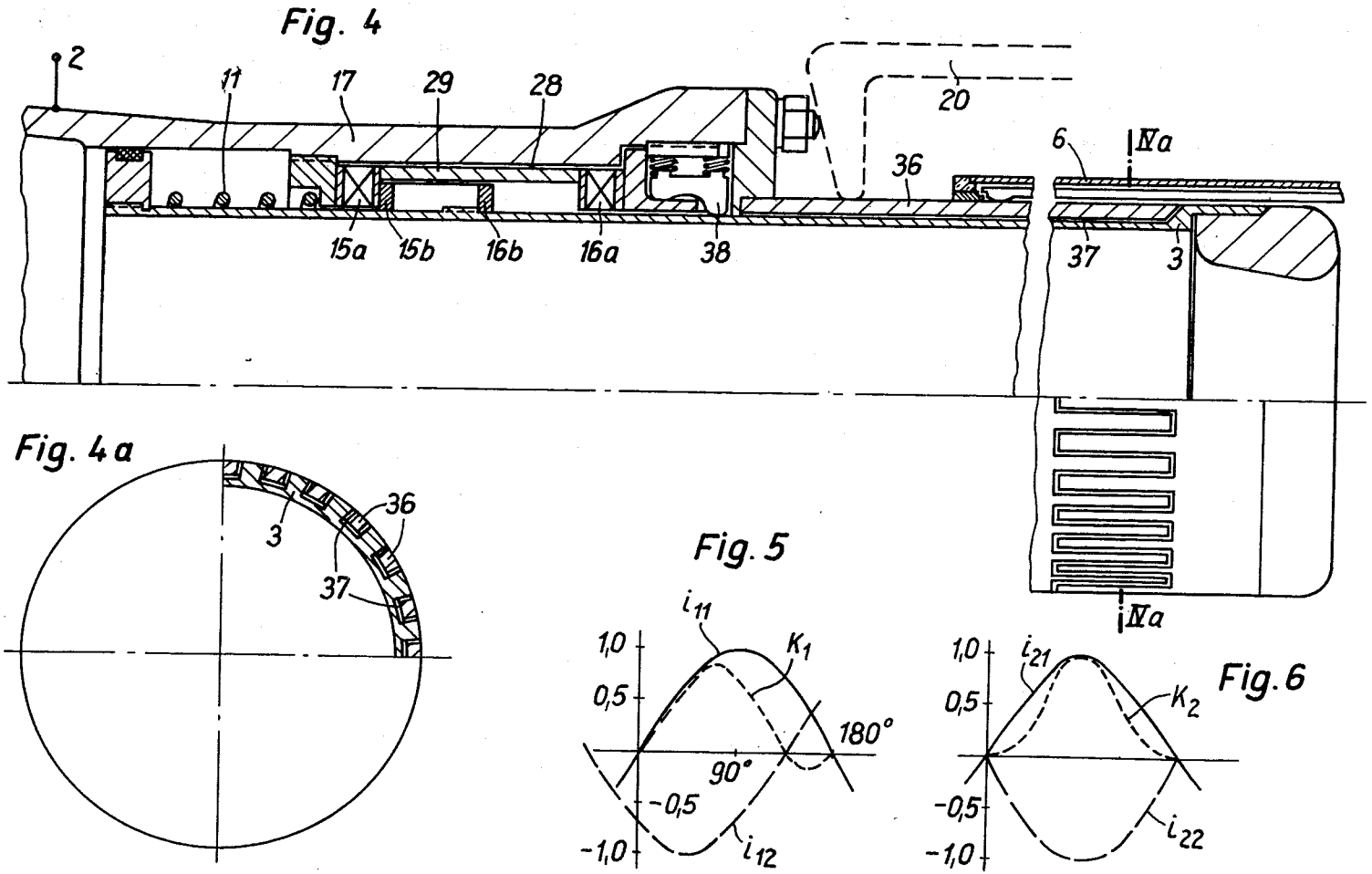

FIG. 4 is a schematic diagram showing how the run-off contact can be provided with a tubular fixed contact telescopically surrounding the run-off contact.

FIG. 4*a* is a section view taken along line IV*a*—IV*a* of FIG. 4.

FIG. 5 illustrates the waveforms of the currents induced in the primary and secondary coils of one of the coil systems of the control device as well as the force developed by these currents.

FIG. 6 illustrates the waveforms of the currents induced in the primary and secondary windings of the other one of the coil systems of the control device as well as the force developed by these currents.

DESCRIPTION OF THE PREFERRED EMBODIMENTS OF THE INVENTION

Figure 1:
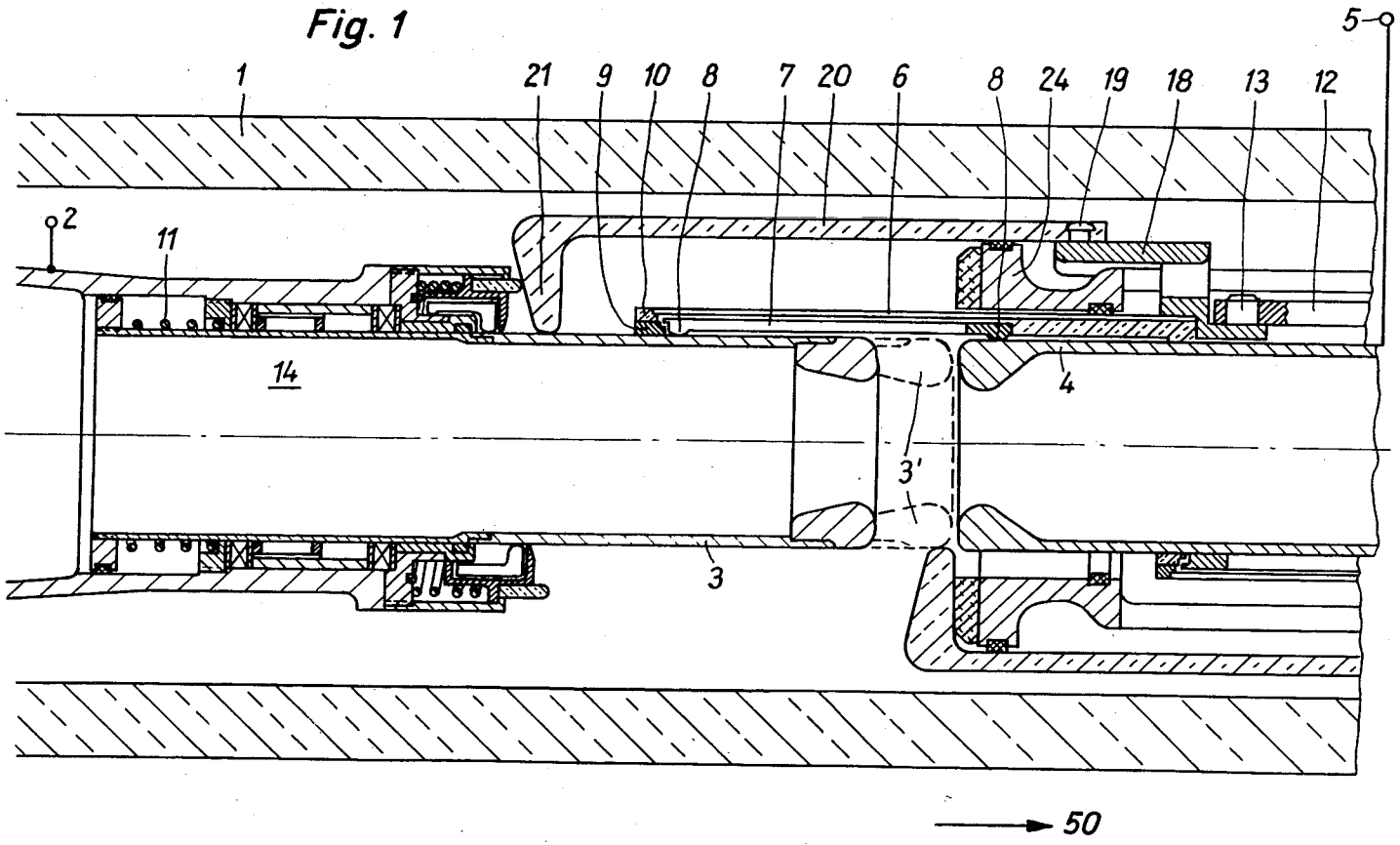
FIG. 1 is a schematic diagram, in longitudinal section, illustrating a pressure gas circuit breaker equipped with a contact arrangement according to the invention. The portion shown above the center line shows the contact arrangement in the closed position.

The high-voltage circuit breaker shown in FIG. 1 is a blast-piston circuit breaker for, say, 110 kV, wherein sulfur hexafluoride is used as the quenching and insulating gas. Only the parts essential for an understanding of the invention are shown. Not shown are the breaker parts at ground potential, the actuator and the support insulators. The breaker has an arcing chamber 1 which consists, for instance, of porcelain. The switching gap is conjointly defined by the first base contact 3 and second base contact 4, which constructed as hollow cylinders for removing the quenching gas. The first base contact 3 is connected to a terminal 2 of the breaker, indicated only schematically, and the base contact 4 to a terminal 5.

The two base contacts 3 and 4 are connected with each other by a tubular bridging contact member 6 in the closed position, as shown at the top of FIG. 1 above the center line. Inside the bridging contact member 6, spring-loaded fingers 7 are positioned which are pressed with their contact surfaces 8 against the base contacts 3 and 4 with predetermined contact pressure. The bridging contact member 6 carries a sliding contact ring 9 of arc-resistant, electrically conductive material with a layer of electrical insulation 10 therebetween. The bridging contact member 6 is screwed into a coupling element 18. The coupling element 18 is connected by means of fastening elements 19 with a tube 20 of insulating material which forms a blasting cylinder.

The blast cylinder carries on its end face 21 a nozzle body which surrounds the base contact 3. The insulating tube 20 is made, for instance, of one piece, for example, of fiber-reinforced plastic. During the switching-off motion, the insulating tube 20, together with the bridging contact member 6, is pulled over a piston 24 stationary relative thereto so that a supply of quenching medium under overpressure is made ready. Tie rods 12, which are linked at a post 13, engage the coupling element 18. With the tie rods 12 is coupled a drive member, not shown, which moves the switch from the closed position shown above the center line into the open position shown below. In the operation, the bridging contact member 6 runs off of the base contact 3 (runoff contact) in the direction of arrow 50.

The arcing chamber 1 is completely filled with sulfur hexafluoride at a pressure of, for instance, 4 bar. This quenching gas is compressed when the insulating tube 20 moves in the direction of arrow 50 because at the beginning of the breaker opening movement, the gap is still closed off by the bridging contact member 6 and the quenching gas cannot yet flow off.

The first base contact 3 can move against the pressure of a spring 11 in the direction toward the stationary base contact 4. This motion is controlled by an electrodynamic control device which as a whole is designated with reference numeral 14. The control device 14 is shown on a larger scale in FIG. 2.

According to FIG. 2, the control device 14 includes two coil systems 15 and 16. The first coil system 15 consist of the primary coil 15*a* and the secondary coil 15*b*; the second coil system 16 consists of the primary coil 16*a* and the secondary coil 16*b*. The primary coils 15*a* and 16*a* are arranged fixed; the secondary coils 15*b* and 16*b* are fixedly connected with the runoff contact 3. The input and output contacts of the primary coils are formed by the metal washers 15*c* and 16*c*. The secondary coils 15*b* and 16*b* may be in the shape of solid metal washers. Through a suitable choice of the dimensions and the material, the secondary coil 15*b* is configured so that a phase angle of about 30° to 60° el occurs between the voltage $u_{12}$, which is induced in it by a changing current in the primary coil 15*a*, and the induced current $i_{12}$, so that therefore, a phase difference of about 120° to 150° el exists between the primary current $i_{11}$ and the secondary current $i_{12}$. The secondary coil 16*b*, on the other hand, is configured so that a phase of about 90° el exists between the induced voltage $u_{22}$ and the secondary current $i_{22}$, so that the secondary current lags the primary current by about 180° el.

In the stationary closed condition of the breaker, the primary coils 15*a* and 16*a* carry no current. The current entering into the metallic tube 17 at 2 flows to the run-off contact 3 through a movable contact member 25. The movable contact member 25 is braced against the insulating tube 20 under the pressure of a spring 26 via a short cylinder piece 27. The primary coils 15*a* and 16*a* are insulated against this current path by an insulating layer 28.

At the beginning of the breaker opening operation, the current to be interrupted is commutated to the coil systems 15 and 16. The currents and forces which occur in the coil systems are shown graphically in FIGS. 5 and 6. For the sake of simplification, it is assumed here that the primary and secondary currents have the same amplitudes; a steady-state condition is assumed. The time-dependent coupling of the individual coil systems is not taken into account.

According to FIG. 5, there exists in the first coil system 15 a phase difference 135° el between the primary current $i_{11}$ and the secondary current $i_{12}$. As a result, a force $K_1$ is produced between the primary coil 15*a* and the secondary coil 15*b*, which increases rapidly after the zero crossing of $i_{11}$ and becomes negative shortly before the next zero crossing.

In the second coil system 16 the phase difference between the primary current $i_{21}$ and the secondary current $i_{22}$ is 180° el; this results in a force $K_2$ which is always positive, that is, repelling.

Because in the course of the movement of the run-off contact 3, the coupling in the first coil system 15 decreases and increases in the second coil system 16, the force $K_1$, after a rapid rise, declines again, while the force $K_2$ increases.

During breaker opening, the operation of the blast-piston breaker according to FIGS. 1 and 2 is as follows:

The breaker opening command given at an arbitrary point in time results in a movement of the insulating tube 20 to the right. Thereby, the cylinder piece 27 is released and the commutation contact 25 also is moved to the right under the pressure of actuation means comprising the spring 26. The current to be interrupted now is thereby commutated to a bypass path containing the primary coils 15*a* and 16*a*; it now flows from 2 via 17 through the primary coil 15*a*, from there through a metallic cylinder 29 to the primary coil 16*a* and continues via the fixed contact 30 and the contact 25 (in the position 25′) to the run-off contact 3.

If now this commutation happens at the beginning of a half-wave, a rapidly rising repulsion force is produced between the coils 15*a* and 15*b*, as may be seen from FIG. 5. This force accelerates the base contact 3 against the pressure of the spring 11 in the direction toward the other base contact 4 into the position 3′ (FIG. 1), so that the gap is shortened. In the course of the half-wave, the bridging contact member 6 runs off of the run-off contact 3; thereby, an arc is produced at the gap 3′–4, which, however, produces considerably less energy than with the non-shortened gap. In addition, the arc is initiated only considerably later than with a fixed gap because the run-off contact 3 first follows the bridging contact member 6. Also, the consumption of quenching gas is less because the gap between the base contacts 3 and 4 and is opened later and is then at first shorter than with a fixed gap. Shortly before the end position 3′ of the run-off contact 3 is reached, a repelling force becomes effective, according to FIG. 6, between the coils 16*a* and 16*b*, which decelerates the run-off contact 3 and accelerates it in the opposite direction with the aid of the spring 11 so that the required extinguishing distance between the base contacts 3 and 4 is reached in time for the zero crossing of the current to be interrupted. In the meantime, the current to be interrupted drops off and approaches the zero crossing, where the arc is extinguished. Thus, only the force of the spring 11 is still effective, which returns the run-off contact 3 to the starting position.

If the commutation of the current to be interrupted to the coils 15*a* and 16*a* becomes effective only in the declining part of the half-wave, an appreciable force $K_1$ no longer is produced in the coil system 15; the run-off contact 3 therefore remains at rest. The same is true for small currents where the arc energy is small anyhow when they are interrupted.

In the arrangement according to FIG. 2, the primary coils 15*a* and 16*a* are connected in series; for the duration of the commutation of the current to be interrupted to the primary coils, the sum of the inductances of the two coil systems is therefore the important factor. The commutation can be facilitated by switching on the primary coils 15*a* and 16*a* sequentially.

FIG. 3 shows an arrangement suitable for this purpose. The fixed contact 30 is connected here with a ring-shaped contact bridge 31 which in turn cooperates with a movable ancillary contact 32. In the position shown in FIG. 3, the ancillary contact 32 is connected with a further ring-shaped, fixed contact member 33, which forms the one terminal of the primary coil 15*a*. The movable contact member 32 lies between the secondary coils 15*b* and 16*b*; it is therefore taken along by the run-off contact 3 when the run-off contact 3 moves. The primary coil 16*a* is bypassed by the contact member 31; the left-hand terminal of the primary coil 16*a* is formed by a fixed contact member 34, which is not in the circuit at the start of the commutation. Otherwise, the arrangement according to FIG. 3 agrees with that of FIG. 2.

In the arrangement according to FIG. 3, the movable contact 25 passes to the fixed contact 30 at the start of the breaker closing motion as in the embodiment according to FIG. 2. Thereby, the current to be interrupted is commutated to a circuit branch which contains the primary coil 15*a* and the contact members 33, 32 and 31. A first electrical structure means then includes contact members 33 and 31 to which the ancillary contact 32 helps commutate the current to be interrupted. As a result, a repelling force is generated between the coils 15*a* and 15*b* of the first coil system whereby the run-off contact 3 is accelerated to the right. In the process, the run-off contact 3 takes the movable ancillary contact 32 along. Only in the last part of this movement does the contact member 32 pass to the fixed contact member 34 which forms a terminal of the second primary coil 16*a*. At the same time, the ancillary contact 32 runs up on a further fixed contact member 35, which bypasses the primary coil 15*a* of the first coil system. Thus, the current to be interrupted still flows only through the second primary coil 16*a*, whereby the motion of the run-off contact 3 is reversed in the manner already described. A second electrical structure means then comprises contact members 34 and 35 to which the ancillary contact 32 also helps commutate the current to be interrupted. The repelling force of the first coil system 15 is completely absent. It will be seen that two commutation processes occur here in which only the individual inductances of the primary coils 15*a* and 16*a* are effective.

Through an appropriate configuration of the contact members 31 to 35, the different times for the two commutation processes can be realized and the control device 14 can thereby be constructed so that an optimum cycle of the breaker opening operation is achieved. While according to FIG. 3, the currentconduction times of the two coil systems 15 and 16 directly follow each other, an interval or an overlap can also be provided between them in other embodiments.

In the arrangements according to FIG. 4, a fixed contact member 36 is arranged with respect to the run-off contact 3. The fixed contact member 36 is of tubular construction and surrounds the run-off contact 3 in telescopic fashion with an insulating layer 37 interposed. In the breaker closed condition, the runoff contact 3 carries no current; the current flows from the terminal 2 through the metallic tube 17 and the fixed contact 36 to the bridging contact member 6. The control device 14 is of the same configuration as in FIG. 2 and is in connection with the run-off contact 3 through the spring-loaded sliding contact 38.

During the breaker opening operation, the bridging contact member 6 moves to the right and thereby passes with its left end from the fixed contact 36 to the run-off contact 3. This commutates the current to be interrupted to the control device 14 through the sliding contact 38. The further actions and motion cycles are the same as were described in connection with FIG. 2.

The run-off contact 3 and the fixed contact 36 advantageously mesh with each other in the range of movement of the runoff contact. This can be seen from the side view according to the lower part of FIG. 4 and the cross-section taken along line IV*a*—IV*a* of FIG. 4 shown in FIG. 4*a*. This configuration is important for switching-on the breaker which is accomplished by moving the bridging contact member 6 to the left. If there is a short circuit at the time the breaker is closed, the coil system 15 is energized immediately as soon as the bridging contact member 6 runs up on the base contact 3 from the right, so that the base contact 3 is accelerated to the right. This could have the result that the further movement of the bridging contact 6 is impeded by a gap between the fixed contact 36 and the runoff contact 3. The interdigitated mesh engagement between these two contacts prevents this from happening as it forms a continuous sliding surface for the bridging contact member 6 over the distance of possible motion of the run-off contact 3.

In the embodiments according to FIGS. 2 to 4, the secondary coils 15*b* and 16*b* are situated between the primary coils 15*a* and 16*a*. However, the arrangement can also be made so that the secondary coils are situated outside the primary coils; then, only the order of the coil systems, relative to the force of the spring 11, must be interchanged; stated otherwise, the first coil system 15 in FIGS. 2 to 4 must be situated to the right and the second coil system 16 to the left.

What is claimed is:

1. In an electric compressed-gas circuit breaker, a contact arrangement for interrupting an electric current comprising:

first base contact means and a second base contact conjointly defining a gap therebetween;

a bridging contact member movable between first and second positions for electrically joining said first base contact means and said second base contact in said first position and for moving in a direction toward said second base contact and running-off of said first base contact means to said second position thereby electrically separating said first base contact means from said second base contact, said first and second positions corresponding to the closed and open positions of the breaker, respectively;

said first base contact means including: a contact structure, a spring arranged at said contact structure and a first base contact movably mounted on said structure so as to be movable in said direction toward said second base contact against the force of said spring; and, an electrodynamic control device including: first coil means for developing a force dependent upon the current to be interrupted for urging said first base contact toward said second base contact against the force of said spring when said breaker is opened;

second coil means for developing a repelling force in response to the current to be interrupted, said repelling force coacting with said spring for decelerating said first base contact in its movement toward said second base contact and for accelerating the same away from said second base contact shortly before zero crossover of said current whereby the spacing of said gap is adjusted for quenching the arc drawn when said bridging contact member separates from said first base contact; and, commutation means for commutating the current to be interrupted to said first coil means and to said second coil means when the breaker is opened.

2. The contact arrangement of claim 1, said first coil means comprising: a first primary coil and a first secondary coil; said second coil means comprising: a second primary coil and a second secondary coil; said secondary coils being fixedly mounted on said first base contact, said primary coils being mounted in the breaker so as to be fixed in position relative to the movement of said first base contact and so as to be adjacent mutually opposite sides of said secondary coils, respectively; said first secondary coil being disposed ahead of said first primary coil in the direction toward said second base contact, said coils of said first coil means being mounted with respect to each other so that they are tightly coupled when the breaker is closed, said coils of said first coil means being configured so that the secondary current in said first secondary coil lags the primary current in said first primary coil by about 120° to 150° el; and, said second secondary coil being disposed behind of said second primary coil in said direction, said coils of said second coil means being mounted with respect to each other so that they are loosely coupled when the breaker is closed, said coils of said second coil means being configured so that the secondary current in said second secondary coil lags the primary current in said second primary coil by about 180° el.

3. The contact arrangement of claim 2, said commutation means comprising: a commutation contact movably mounted in said contact structure for commutating the current to be interrupted to said first and second primary coils; and, actuation means for actuating said commutation contact at the beginning of the breaker opening operation whereby the current to be interrupted flows through said primary coils.

4. The contact arrangement of claim 2, said first base contact means including: a stationary contact fixedly mounted to said contact structure so as to be an electrical contact with said bridging contact member when the breaker is in the closed position, said stationary contact being insulated with respect to said first base contact; and, a contact mounted in said contact structure for connecting said primary coils directly to said first base contact when the breaker is in the closed position.

5. The contact arrangement of claim 4, said stationary contact and said first base contact each having a contact surface disposed in the path of said bridge contact member whereby said bridge contact member commutates the current to be interrupted from said stationary contact to said first base contact when said bridging contact member moves from said first position to said second position.

6. The contact arrangement of claim 4, said first base contact and said stationary contact each having digitated portions, said portions being interdigitated so as to conjointly define a smooth sliding surface for said bridging contact member in the region of movement of said first base contact.

7. The contact arrangement of claim 2, said commutation means comprising: ancillary contact means for commutating the current to be interrupted at the beginning of the breaker opening operation first only to said first primary coil and then later to said second primary coil after said first base contact has moved a predetermined distance.

8. The contact arrangement of claim 7, said ancillary contact means comprising: first electrical contact structure means connected to said first primary coil arranged in the path of movement of said first base contact; second electrical contact structure means connected to said second primary coil and disposed in said path away from said first electrical contact structure means; and, an ancillary contact movably mounted in said contact structure of said first base contact means so that the same can be moved along by said first base contact for sequentially commutating the current to be interrupted to said first electrical contact structure means for a time corresponding to a portion of the movement of said first base contact and then commutating said current away from said first electrical contact structure means and later commutating said current to said second electrical contact structure means after said first base contact has moved a predetermined distance toward said second base contact.

9. The contact arrangement of claim 1 for interrupting an electric current in a blast-piston circuit breaker wherein the circuit breaker includes: a cylinder for holding the gas therein, and a piston disposed in said cylinder, said cylinder and said piston being mounted with respect to said contact arrangement so as to cause a relative movement between said piston and said cylinder when said bridging contact member moves to the open position to impart sufficient energy to the gas for blasting the same through the arc drawn when said bridging contact member separates from said first base contact.

* * * * *